US007594544B2

(12) United States Patent
Ruddock

(10) Patent No.: US 7,594,544 B2
(45) Date of Patent: Sep. 29, 2009

(54) DOWNHOLE TUBULAR SEALING SYSTEM

(75) Inventor: David B. Ruddock, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 152 days.

(21) Appl. No.: 11/874,438

(22) Filed: Oct. 18, 2007

(65) Prior Publication Data

US 2009/0102133 A1 Apr. 23, 2009

(51) Int. Cl.
*E21B 33/12* (2006.01)
*E21B 33/10* (2006.01)

(52) U.S. Cl. ..... 166/387; 277/300; 285/333; 285/382

(58) Field of Classification Search ..... 166/116, 166/115, 242.7, 242.6, 380; 285/355, 390, 285/145.1, 145.2
See application file for complete search history.

(56) References Cited

U.S. PATENT DOCUMENTS

| | | | | |
|---|---|---|---|---|
| 4,187,906 | A | 2/1980 | Kovacs | |
| 4,641,841 | A * | 2/1987 | Regan | 277/336 |
| 5,520,252 | A | 5/1996 | McNair | |
| 6,896,049 | B2 | 5/2005 | Moyes | |
| 7,134,506 | B2 | 11/2006 | Moyes | |
| 7,234,533 | B2 | 6/2007 | Gambier | |
| 2003/0102669 | A1 * | 6/2003 | Tsujimura et al. | 285/333 |
| 2004/0090068 | A1 * | 5/2004 | Evans et al. | 285/382 |
| 2007/0235191 | A1 | 10/2007 | Loughlin | |

OTHER PUBLICATIONS

International Search Report with Written Opinion, PCT/US2008/079721, date mailed Apr. 13, 2009, Search Report having 5 pages, Written Opinion having 5 pages.
"High Expansion Metal Seal Eliminates Failures Common to Elastomer Seals," JPT Online, Oct. 5, 2006. 2 pages.
Head, Phil, et al. "Slimwell Concept- Innovative Coiled Tubing Completion Technology," SPE 54492, Houston, Texas, May 25-26, 1999. 14 pages.
Rignol, J., et al. "Worldwide First Run in Hole of a Dope-Free 13Cr Production Tubing String," SPE 95507, Dallas Texas, Oct. 9-12, 2005. 5 pages.
Baker, Alan, et al. "Permanent Monitoring- Looking at Lifetime Reservoir Dynamics," Oilfield Review, Winter 1995. pp. 32-46. 15 pages.
Baker Oil Tools, Packer Systems, Permanent Packer Accessories, pp. 41, 45, 48-49. Date unknown, Retrieved online on Oct. 2, 2008 from: http://www.mines.edu/academic/courses/petro/pegn361/Packer%20Systems.pdf.
Sapex Oil Tools, LTD. "Sapex-DL Completion Equipment, Model "K" Tubing Expansion Joint and Model "KT" thermal Expansion Joint" pp. 40 and 41. Date Unknown, Retrieved online on Oct. 2, 2008 from: http://www.scoretrinidad.com/downhole-tools/SAPEX-Catalogue-4-Downhole-Completions-RevIV-3of4.pdf.

* cited by examiner

*Primary Examiner*—Jennifer H Gay
*Assistant Examiner*—Yong-Suk Ro
(74) *Attorney, Agent, or Firm*—Cantor Colburn LLP

(57) ABSTRACT

Disclosed herein is a downhole disconnectable and length compensatable tubular sealing system. The system includes, a seal connector having a first metal seal receptive of a separate seal nipple and pressure sealably engagable therewith and at least one expansion joint sealingly connected to the seal connector. The expansion joint includes, a section of metal tubing having a sealing surface thereon and a metal-to-metal seal slidably sealingly engaged with the sealing surface.

20 Claims, 3 Drawing Sheets

DOWNHOLE TUBULAR SEALING SYSTEM

BACKGROUND OF THE INVENTION

The hydrocarbon recovery industry often has a need to seal tubulars to downhole structures. Such seals are exposed to caustic chemicals as well as high temperatures and high pressures that can degrade seals and that can result in undesirable leakage. Additionally, variations in temperature cause contraction and expansion of tubulars sealed to one another positioned within the wellbore. Such contraction and expansion can put stress on the seals, which may result in premature failure of the seals. The art, therefore, would be receptive to downhole tubular sealing systems that can maintain seal integrity during exposure to the foregoing conditions.

BRIEF DESCRIPTION OF THE INVENTION

Disclosed herein is a downhole disconnectable and length compensatable tubular sealing system. The system includes, a seal connector having a first metal seal receptive of a separate seal nipple and pressure sealably engagable therewith and at least one expansion joint sealingly connected to the seal connector. The expansion joint includes, a section of metal tubing having a sealing surface thereon and a metal-to-metal seal slidably sealingly engaged with the sealing surface.

Further disclosed herein is a method of length compensatingly sealably connecting a tubular to a downhole structure. The method includes, positioning a metal nipple sealingly engaged to an actuatable first metal seal within a downhole structure, actuating the first metal seal to thereby sealingly engage the first metal seal to the downhole structure, positioning a metal seal connector having a second metal seal at the metal nipple, radially deforming the second metal seal to sealingly engage the metal seal connector to the metal nipple and slidably sealingly engaging at least one first metal tubular to at least one second metal tubular with a metal-to-metal seal. Additionally, the at least one second metal tubular is sealingly engaged to the metal seal connector.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
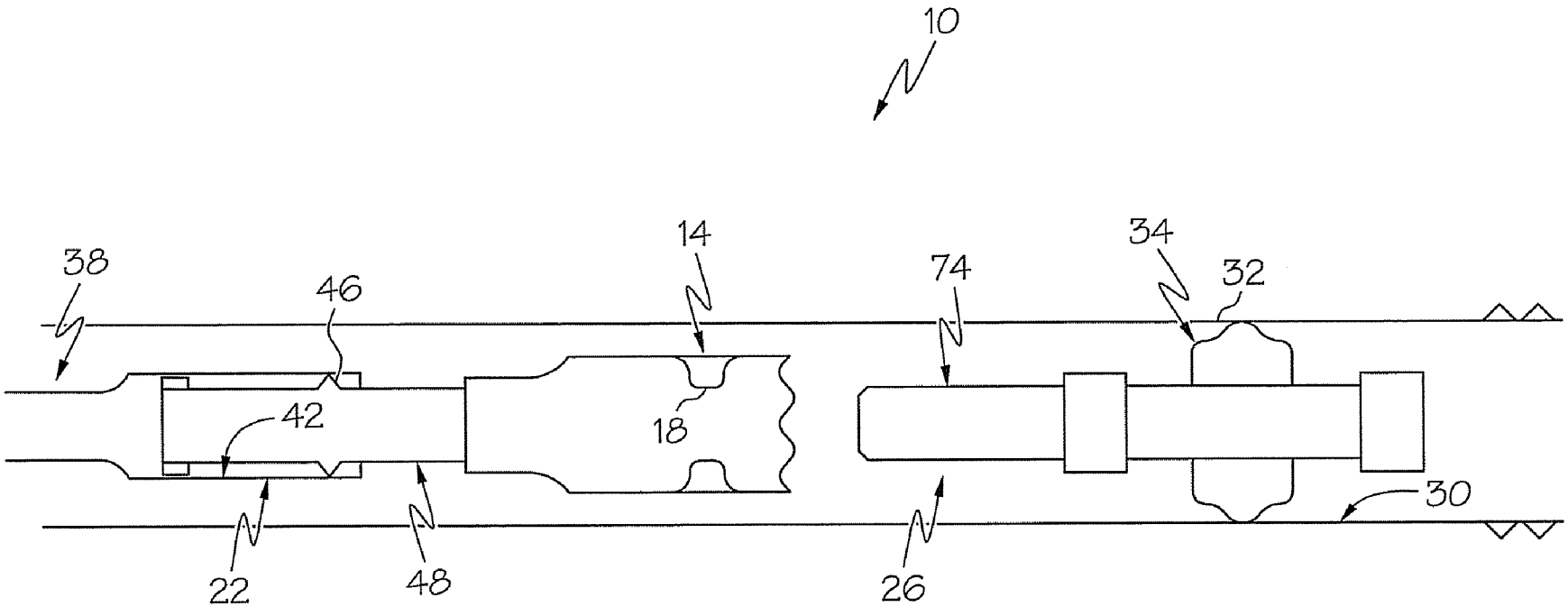
FIG. 1 depicts the tubular sealing system disclosed herein being run downhole.

Referring to FIG. 1, an embodiment of the downhole disconnectable and length compensatable tubular sealing system 10, disclosed herein, is illustrated. The tubular sealing system 10 includes, among other things, a seal connector 14 having an actuatable metal seal 18, and an expansion joint 22, both of which utilize all metal seals as disclosed herein as will be described below. The seal connector 14 is sealable to a nipple 26 with the actuatable metal seal 18. The nipple 26 is sealable to a sealing surface 30 of downhole structure 32 such as a casing or wellbore, for example, with a metal seal 34 in a device such as a packer, for example. The foregoing structure allows a well operator to sealably connect and disconnect tubulars, suspended from the surface, to the nipple 26, while the nipple 26 remains downhole and sealed to the structure 32. The expansion joint 22 includes a first tubular 38 having a seal surface 42, depicted herein as an inner diametrical surface thereon, and a metal-to-metal seal 46, sealably attached to a second tubular 48. This arrangement can be used to convey fluids, such as mud and steam, for example, downhole, as well as to recover hydrocarbons from downhole during production. By incorporating the metal seals 18, 34 and 46, the sealing system 10 is able to withstand the high temperatures, high pressures and caustic environments often encountered downhole while sealingly compensating for contractions and expansions of tubulars within the system that occur with changes in temperature, including ultra high temperatures encountered with some steam injection processes.

Figure 2:
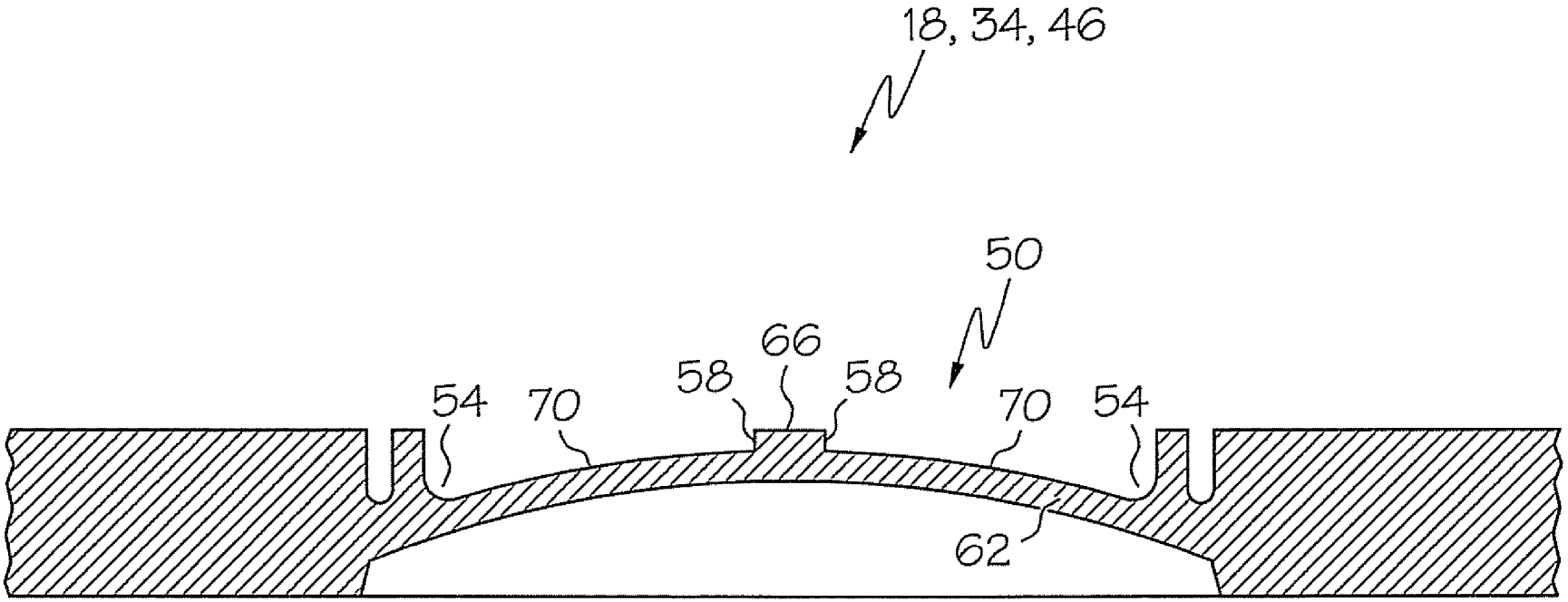
FIG. 2 depicts a metal seal disclosed herein.

Referring to FIG. 2, an embodiment of the metal seals 18, 34 and 46 is illustrated in a non-actuated and thus non-sealing configuration. The metal seals 18, 34 and 46 in this embodiment include a radially deformable portion 50. The radially deformable portion 50 has areas of weakness 54, 58 that deform in response to axial compression of the metal seal 18, 34 and 46. In this embodiment, the areas of weakness 54, 58 are formed by changes in thickness of a wall 62 of the seal 18, 34 and 46. Alternate embodiments could have the areas of weakness formed in other ways such as by changes in material properties, for example. A direction of radial deformation of the seal 18, 34 and 46, in this embodiment, is controlled by geometric relationships of each of the areas of weakness 54 and 58 to one another. For example, if the areas of weakness 58 are positioned at a larger radial dimension from an axis of the seals 18, 34 and 46 than the areas of weakness 54, the areas of weakness 58 will tend to deform radially outwardly in response to axial compression thereof, as is the case for seals 34 and 46. Such outward radial deformation can continue until an optional seal bead 66 contacts a seal surface of a mating component. Alternately, by positioning the areas of weakness 58 radially inwardly relative to the areas of weakness 54 the areas of weakness will tend to deform radially inwardly in response to axial compression thereof, as is the case for seal 18.

Once seal bead 66 contacts a mating sealing surface, such as the seal surface 30 or 42, additional axial compression of the seals 18, 34 and 46 will cause deformation of legs 70, located on either longitudinal side of the seal bead 66. Since the legs 70 are primarily in compression, due to the geometrical relationship of the legs 70 to the deformable areas 54, 58, any deformation of the legs 70 will tend to be in the form of buckling. In order to control such buckling deformation of the legs 70 a non-straight configuration of the legs 70 may be desirable. In the embodiment of FIG. 2, for example, this non-straight configuration is an arc. Thus, the legs 70 will tend to deform in a bowed shape as they are compressed. This bowing shape is quite stable and permits the deformed legs 70 to retain elasticity such that they act as biasing members that spring back when the compressive loads are removed. As such, the seals 18, 34 and 46 are able to accommodate larger variations in dimensions of the mating seal surfaces 30, 42, and 74 than they would with less elastic leg configurations.

The radial deformation of the seals 18, 34, 46 that results from axial compression of the seals 18, 34 and 46 provides another advantage to a well operator. Deformation of the seals 18, 34 and 46 is reversible. That is, axial expansion of the seals 18, 34 and 46, after they have been radially deformed, causes the radial deformation to reverse such that the seals 18, 34 and 46 return to their original shape, or near original shape. After such reverse deformation, the metal seals 18, 34 and 46 are no longer sealingly engaged with their mating seal surfaces 30, 42 and 74 and as such can be withdrawn from their mating seal surfaces 30, 42 and 74. Linear actuator tools, known in the industry, can, therefore, be used to axially compress and axially expand the seals 18, 34, 46 thereby causing increases and decreases in radial deformation thereof.

Referring again to FIG. 1, increases and decreases in radial deformation of the metal seal 18, of the seal connector 14, allows the metal seal 18 to sealably connect and disconnect from the nipple 26. To seal the seal connector 14 to the nipple 26, in this embodiment, the metal seal 18 is positioned around the nipple 26 and the metal seal 18 is axially compressed causing the metal seal 18 to deform radially inwardly until it makes contact with and sealingly engages with a seal surface 74 of the nipple 26. It should be noted that alternate embodiments could have a nipple with a sealing surface on an inner radial surface as opposed to an outer surface thereof. Such a nipple would be sealable to a radially outwardly expandable metal seal similar to the seals 34 and 46. The nipple 26, by being made of metal, establishes a metal-to-metal seal with the metal seal 18 of the seal connector 14. Additionally, alternate embodiments (not shown) could have the metal seal 18 already in a radially deformed configuration prior to being sealably connected to the nipple 26. Such an embodiment would need piloting features to align the nipple 26 with the metal seal 18 prior to engagement therewith. A tapered or radiused nose on the nipple 26 would also be helpful in guiding the nipple 26 into the metal seal 18 to prevent damage to either component during assembly therebetween.

The metal seal 46 while being sealingly engaged with the seal surface 42 can also slide axially relative to the first tubular 38. As such, an axial length of the seal surface 42 can be set according to the needs of each particular application to accommodate an axial expansion and contraction of the tubulars 38 and 48 that is expected due to the anticipated temperature changes that will be encountered.

Figure 3:
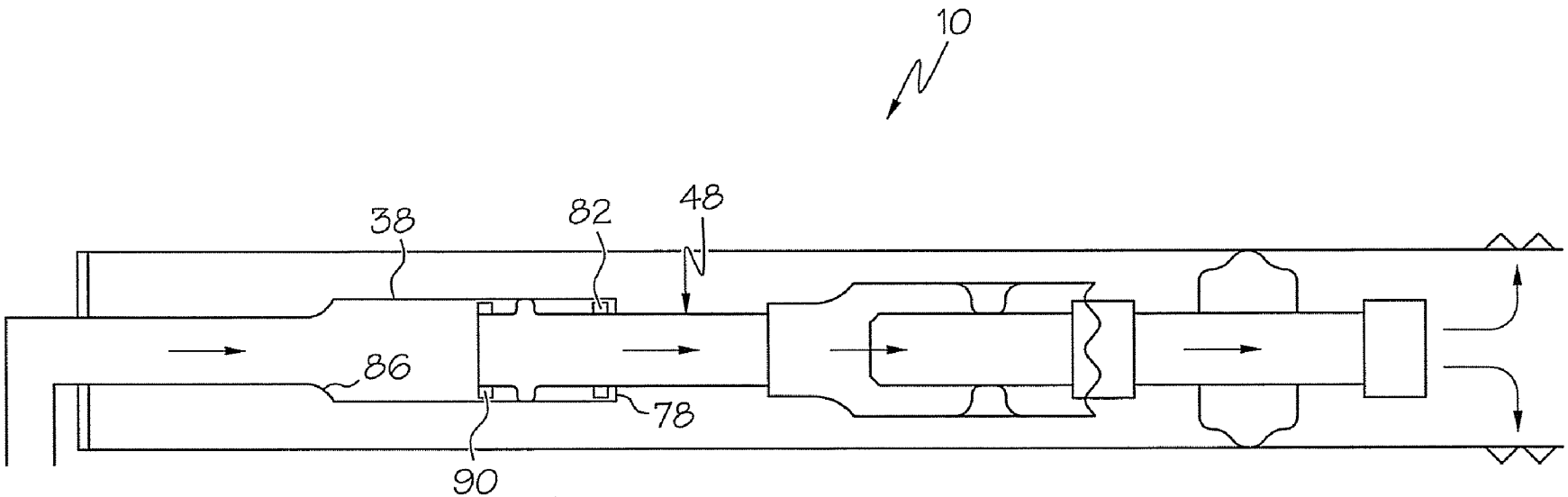
FIG. 3 depicts the tubular sealing system of FIG. 1 connected to a downhole nipple.

Referring to FIG. 3, an axial length of the sealing engagement of the seal 46 with the surface 42, in the expansion joint 22, can be limited by locating a series of stops along the first tubular 38 and the second tubular 48. For example, a first stop 78 on the first tubular 38 that is contactable with a second stop 82 on the second tubular 48 will limit an axially expansive travel of the expansion joint 22 when the first stop 78 comes into contact with the second stop 82. Similarly, a third stop 86 on the first tubular 38 that is contactable with a fourth stop 90 on the second tubular 48 will limit axially compressive travel of the expansion joint 22 when the third stop 86 comes into contact with the fourth stop 90. Such travel limits of the expansion joints 22 can allow a well operator to more precisely determine locations of components along a drill string after running downhole.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole disconnectable and length compensatable tubular sealing system, comprising:

a seal connector having a first metal seal receptive of a separate seal nipple and pressure sealably engagable therewith; and at least one expansion joint sealingly connected to the seal connector, including:

a section of metal tubing having a sealing surface thereon; and a metal-to-metal seal slidably sealingly engaged with the sealing surface.

2. The downhole sealing system of claim 1, wherein the metal seal of the seal connector is selectively actuatable.

3. The downhole sealing system of claim 2, wherein the selective actuation is by way of axial compression thereof.

4. The downhole sealing system of claim 1, wherein the seal nipple is metal.

5. The downhole sealing system of claim 1, wherein the first metal seal actuates radially inwardly.

6. The downhole sealing system of claim 1, wherein the first metal seal is disconnectable from the nipple when deformation of the first metal seal is retracted.

7. The downhole sealing system of claim 1, wherein the nipple is sealably connectable to a downhole structure with a second metal seal.

8. The downhole sealing system of claim 7, wherein the second metal seal is actuatable through axial compression thereof.

9. The downhole sealing system of claim 7, wherein the second metal seal is part of a packer.

10. The downhole sealing system of claim 1, wherein the first metal seal includes at least one area of weakness.

11. The downhole sealing system of claim 1, wherein the first metal seal retains elasticity when deformed through a shape thereof.

12. The downhole sealing system of claim 1, wherein the slidable sealing engagement of the at least one expansion joint accommodates temperature related length changes of tubulars.

13. The downhole sealing system of claim 1, wherein the at least one expansion joint further comprises at least one stop to limit longitudinal travel thereof.

14. The downhole sealing system of claim 13, wherein the at least one expansion joint includes two stops to bi-directionally limit travel thereof.

15. The downhole sealing system of claim 1, wherein sealing integrity of the first metal seal, the second metal seal and the metal-to-metal seal are maintained during injection of steam therethrough.

16. A method of length compensatingly sealably connecting a tubular to a downhole structure, comprising:

positioning a metal nipple sealingly engaged to an actuatable first metal seal within a downhole structure;

actuating the first metal seal to thereby sealingly engage the first metal seal to the downhole structure;

positioning a metal seal connector having a second metal seal at the metal nipple;

radially deforming the second metal seal to sealingly engage the metal seal connector to the metal nipple; and slidably sealingly engaging at least one first metal tubular to at least one second metal tubular with a metal-to-metal seal, the at least one second metal tubular being sealingly engaged to the metal seal connector.

17. The method of claim 16, wherein the actuating of the first metal seal further comprises axially compressing the first metal seal.

18. The method of claim 16, wherein the radially deforming of the second metal seal further comprises axially compressing the second metal seal.

19. The method of claim 16, wherein the positioning the second metal seal further comprises hanging the second metal seal from a surface by the at least one first metal tubular and the at least one second metal tubular.

20. The method of claim 16, further comprising radially retracting the second metal seal to sealingly disengage the metal seal connector from the metal nipple.

* * * * *